US005855081A

United States Patent [19]

Cuesta et al.

[11] Patent Number: 5,855,081

[45] Date of Patent: Jan. 5, 1999

[54] STEAM IRON WITH PUMP MECHANISM

[75] Inventors: Xavier Cuesta; Jose Recasens, both of Esplugues Del Llobregat, Spain

[73] Assignee: Braun Aktiengesellschaft, Frankfurt, Germany

[21] Appl. No.: 944,882

[22] Filed: Oct. 6, 1997

[30] Foreign Application Priority Data

Nov. 1, 1996 [DE] Germany ..... 196 45 108.6

[51] Int. Cl.[6] ..... D06F 75/18

[52] U.S. Cl. ..... 38/77.5

[58] Field of Search ..... 38/77.3, 77.83, 38/77.5; 219/245; 239/569, 570; 222/330

[56] References Cited

U.S. PATENT DOCUMENTS

| | | | |
|---|---|---|---|
| 4,170,835 | 10/1979 | Bain, Jr. | 38/77.5 |
| 5,038,501 | 8/1991 | Hipp et al. | 38/77.5 |
| 5,136,796 | 8/1992 | Farrington | 38/77.5 |
| 5,526,594 | 6/1996 | Fourny et al. | 38/77.5 |

FOREIGN PATENT DOCUMENTS

| | | | |
|---|---|---|---|
| 258253 | 7/1988 | Germany | 38/77.5 |

*Primary Examiner*—Ismael Izaguirre
*Attorney, Agent, or Firm*—Fish & Richardson P.C.

[57] ABSTRACT

The invention is directed to a piston pump for a steam iron, including a pump housing (10) provided in a housing bore (12) for receiving an axially movable piston (14), said piston (14) combining with the housing bore (13) to form a pressure generating chamber (13) connected with at least two outlets (16, 18) for at least two liquid consuming devices and with an inlet (20), said piston (14) further including a distributor bore (28) in which a distributor element (26) is rotatably mounted which includes at least one conduit (30, 32) with an inlet port (34, 36), through which conduit, in dependence upon the rotary position of the distributor element (26), one of the liquid consuming devices is supplied with pumped liquid through a connecting conduit (44) communicating with the pressure generating chamber (13). To provide a piston pump sealing tightly and being producible to more lenient manufacturing tolerances, it is proposed providing the distributor element (26) with a separate conduit (30, 32) having each an inlet port (34, 36) for each liquid consuming device, and providing a seal (40) which seals the inlet ports (34, 36) relative to each other and is adapted to be acted upon by a compressive force to effect a seal.

14 Claims, 3 Drawing Sheets

STEAM IRON WITH PUMP MECHANISM

BACKGROUND OF THE INVENTION

This invention relates to a steam iron with a pump mechanism according to the prior-art portion of patent claim 1.

From U.S. Pat. No. 3,691,660 a piston pump for a steam iron is known which feeds pumped water either to a water spray or to an extra burst of steam. The two liquid consuming devices involving the water spray and the extra burst of steam are selected in dependence upon the rotary position of a common actuator, with the same actuator being depressed to direct the liquid pumped into a pressure-generating chamber by means of an axially movable piston to one of the liquid consuming devices. For opening one of the outlets provided on the pump housing in dependence upon the rotary position of the actuator while the other outlet is maintained closed, a distributor element is inserted in a cavity of the pump housing. The distributor element is connected with the actuator in a manner preventing relative rotation and has a central bore and a radial bore extending to one side, so that the pumped liquid is directed through the central bore and the radial bore to one of the outlets. Considering that the outlets are arranged opposite each other at the same level on the pump housing, this piston pump requires plenty of mounting space in the steam iron. Further, the complex structure of this piston pump makes it relatively elaborate to manufacture, requiring relatively high manufacturing accuracy particularly in the area of the outlets between the circumferential surface of the distributor element and the opposite inner surface in order to provide an easily rotating distributor element on the one hand and a tight seal for the outlet to be closed on the other hand.

A piston pump similar to this one in respect of its basic structure is known from European patent application 497 470. In this application, two outlets equally arranged opposite each other at the same level on the pump housing are supplied with pumped liquid through a distributor element arranged both rotatably and axially displaceably in the interior of an axial housing bore. The circumferential surface of the distributor element is configured such that only one outlet at a time is opened, depending on the distributor element's rotary position. In this event, the end of the distributor element forms at the same time the piston, so that the pressure-generating chamber is formed by the cavity defined between a ball valve at the inlet of the housing bore, the piston upper surface, and a ball valve at the outlet. The dual function of the distributor element which includes the added piston function has, however, the disadvantage that a seal relative to the distributor element and the outlet to be closed demands a major manufacturing effort, because the seal is required to be effective during both rotation and longitudinal displacement of the distributor element.

From EP 0 694 646 A1 a steam iron is known which incorporates a common pump mechanism for two liquid consuming devices. An axially movable piston has a central bore communicating with one of the two liquid consuming devices in dependence upon which of the two push-buttons is pressed. By pressing one of the push-buttons, the piston is displaced on the one hand, while on the other hand a seal is urged into sealed engagement with a supply conduit leading to the non-selected liquid consuming device. As a result of the eccentric arrangement of the two push-buttons, the housing wall guiding the piston axially is subjected to one-sided wear. Moreover, this system is susceptible to incorrect operation because the two push-buttons are arranged closely side-by-side.

A steam iron with a pump mechanism of the type initially referred to is known, for example, from applicant's PV 1210 series of steam irons. FIG. 5 illustrates a longitudinal section through a piston of such a pump mechanism. This piston is axially movably mounted in a housing bore of a pump housing, not shown, for compressing a pressure-generating chamber. The piston has an axial distributor bore in which a distributor element is inserted. The distributor element has its upper end area connected with an activating element, so that an operator, in using the same activating element, displaces the piston axially by a pressing motion and the distributing element by a rotating motion.

The distributor element includes further a central conduit opening into a connecting conduit at the frontal bearing surface of the distributor bore. The connecting conduit of the piston communicates with the pressure generating chamber through a ball valve. The central conduit of the distributor element has its upper end connected with an outlet for the water spray through a radial bore, in addition to having its mid-region connected with an outlet for the extra shot of steam through another radial bore. The two radial bores of the distributor element are disposed in a 180° offset relation to each other.

The distributor element of the known piston pump includes two seals arranged above and beneath the upper radial bore on the circumference of the distributor element. The distributor element is surrounded by a non-rotatably mounted sleeve having an opening each in the area of the two outlets. The sleeve and the distributor element are made of stainless steel, with the inside diameter of the sleeve and the outside diameter of the distributor element being relatively coordinated and manufactured to close tolerances in order to obtain a tight seal between the two outlets while at the same time ensuring ease of rotation of the distributor element. Accordingly, the manufacture of the known piston pump has the undesired effect of necessitating a relatively high production effort.

It is therefore an object of the present invention to provide a piston pump of the type initially referred to which involves less manufacturing effort and has in particular tightly sealed fluid paths without the need to specify close manufacturing tolerances for this purpose.

SUMMARY OF THE INVENTION

According to the present invention, this object is accomplished in a steam iron with a pump mechanism, as described below. Providing one conduit each for each liquid consuming device in the distributor element results in a structural separation of the two fluid paths for each liquid consuming device, so that they can be sealed relative to each other with simple means. Thus, during a compression stroke of the piston only that conduit of the distributor element is acted upon by a water pressure that is in fluid communication with the chamber or pressure generating chamber. Any residual liquid quantities in the respective other conduit can drip out of the non-selected outlet for lack of pressure application. Because the seal is adapted to be acted upon by a compressive force to effect a seal, the sealing effect of this seal is improved significantly, also in the event of the distributor element or the surrounding distributor bore being manufactured to more lenient tolerances. Conforming itself ideally to the contour to be sealed by compressive action, the seal seals the inlet ports relative to each other reliably.

Because, in an advantageous aspect of the invention, the seal performs the sealing function by actuation of the piston, it is not necessary to utilize a further force means as, for example, a spring device, for exerting the compressive force. Advantageously, the seal thus seals the inlet ports relative to each other only during axial displacement of the piston. The seal is not acted upon by a compressive force when the distributor element is rotated in order to select a particular liquid consuming device. This enables the distributor element to be rotated with greater ease, in addition to reducing seal wear.

In another advantageous aspect of the invention, a particularly simple seal is obtained by an O-ring which is arranged around one of the inlet ports. By arranging the seal in the end surface of the distributor element in a plane normal to the axis in the direction of piston displacement, the seal is acted upon by a compressive force directed in optimum manner vertically to the seal.

In a particularly advantageous aspect, the direction of force lines of the compressive force exerted to effect a seal is further optimized by the provision of a contact surface between an activating element and the distributor element, which contact surface is arranged vertically above the seal. Thus the compressive force exerted is directed from the activating element to the distributor element to the section of the end surface in which the first seal is arranged.

In a further advantageous configuration of the piston pump, the conduits are each formed of a bore section and a transverse groove, said transverse groove affording ease of manufacture in addition to registering with the associated outlet particularly reliably.

Preferably with bore sections configured as elongated holes in cross-section, the inlet port adjoining the bore section is caused to register with the connecting conduit over a wider range of the rotation angle of the distributor element in an advantageous manner.

A particularly safe seal of the bore sections and transverse grooves relative to each other when the bore sections are arranged eccentrically to the axis of rotation, and the transverse grooves are disposed in the 180° offset relation to each other.

By arranging the outlets in superposed fashion laterally on the piston, the piston pump affords the advantage of being mountable in the steam iron also where space is limited.

Preferably, the transverse grooves are arranged on the distributor element at different levels and each at the height of its associated outlet, and the transverse groove lying closer to the actuating element is sealed relative to the transverse groove situated therebelow and relative to the environment thereabove by a respective peripheral seal disposed on the circumference of the distributor element. This configuration provides an additional seal between the two conduits and relative to the environment.

In a further advantageous aspect, the liquid consuming devices provided include a water spray and a water supply to produce an extra shot of steam issuing from the iron's soleplate, with the seal being provided around the inlet opening for the water spray, and the peripheral seals being arranged in sealing fashion around the transverse groove for the water spray. This results in a particularly tight seal around that conduit in which the higher fluid pressure is built up on actuation.

In a further advantageous feature, a piston spring is provided to return the piston into the home position upon completion of a compression cycle in the pressure generating chamber.

Advantageously, the inlet valve is a flap valve which is particularly insusceptible to lime deposits and contamination. By configuring the outlet valve as a spring-loaded ball valve, operational reliability of the valve is ensured, regardless of the position of the steam iron.

BRIEF DESCRIPTION OF THE DRAWINGS

The present invention will be described in more detail in the following with reference to an embodiment illustrated in the accompanying drawings, in which.

DESCRIPTION OF THE PREFERRED EMBODIMENT

Figure 1:
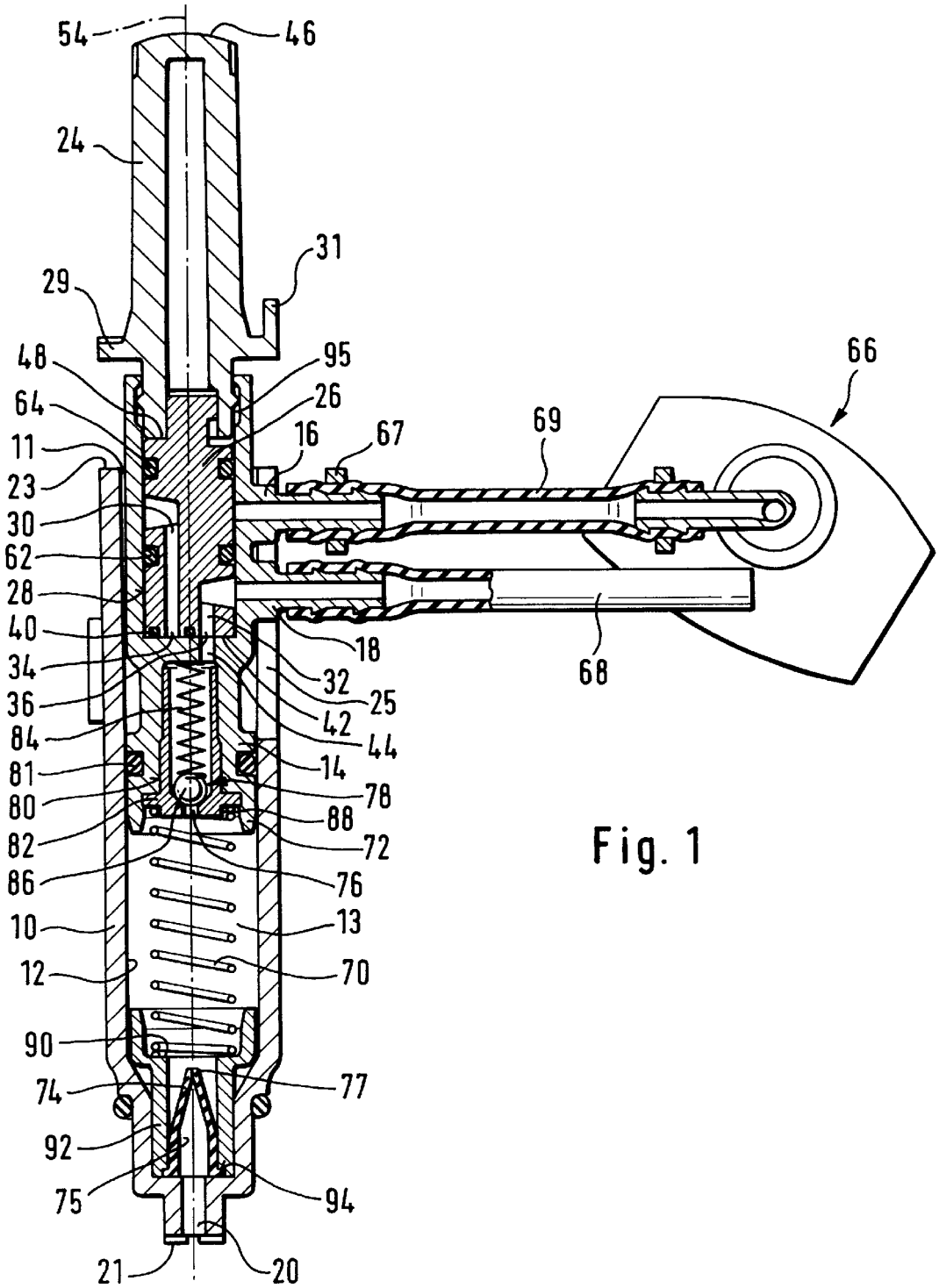
FIG. 1 is a longitudinal sectional view of a pump mechanism embodying the present invention.

FIG. 1 shows in longitudinal section a pump mechanism or piston pump for two liquid consuming devices.

The piston pump includes an essentially rotationally symmetrical pump housing 10 in which a cavity is formed by a central longitudinal bore or housing bore 12. Provided at either end 21, 23 of the pump housing 10 are orifices 20 and 11, respectively, with the lower orifice 20 as seen when looking at the piston pump in its built-in position serving as an inlet which is in fluid communication with a water reservoir, not shown in the Figure, of the steam iron. An elongated hole 25 which is open towards the upper end 23 is provided laterally on the pump housing 10.

Received in the housing bore 12 is a piston 14 which is movable in the longitudinal direction of the pump housing 10. In this arrangement, the outside diameter of the essentially rotationally symmetrical piston 14 conforms to the inside diameter of the housing bore 12, such that the piston 14 has a certain freedom of slidable movement within the housing bore 12. Two outlets 16, 18 are integrally formed with the piston 14 laterally and are arranged in a superposed position in the longitudinal direction. The outlets 16, 18 serve to establish communication of the piston pump with the liquid consuming devices, such as extra shot of steam and water spray 66. The outlets 16, 18 are guided in the elongated hole 25 between a lower end position of the piston 14 and an upper end position. This additional guiding of the piston 14 through the outlets 16, 18 provides not only for a safe limiting of the piston end positions but also prevents the piston 14 from being rotated relative to the pump housing 10. (In FIG. 1 the piston 14 is shown in its upper end position.)

In the upper half of the piston 14 adjacent to the outlets 16, 18 is a hollow cylindrical distributor bore 28 which is of an upwardly open configuration—in the position of the piston pump as installed—to receive a distributor element 26. The openings for the outlets 16, 18 open laterally into the distributor bore 28. A connecting conduit 44 terminates at a bearing surface 42 of the distributor bore 28, which bearing surface is arranged in a plane normal to the longitudinal axis 54 of the piston pump. The connecting conduit 44 is in fluid communication with the water pumped through the inlet 20. In its upper orifice area through which the distributor element 26 is inserted, the distributor bore 28 has a radial enlargement 95 in which an activating element 24 engages.

At the end section 72 of the piston 14 on the side close to the inlet 20, an O-ring 81 made of plastic or rubber is arranged on the periphery, effecting a seal between the piston 14 and the pressure generating chamber 13. Provided at the piston end section 72 is an axial valve bore 80 into which an essentially hollow cylindrical valve insert body 82 is inserted for accommodating an outlet valve 78. Featuring a spring 84 and a spherical body 86, the outlet valve 78 is configured as a spring-loaded ball valve. The spring 84 is guided in the valve insert body 82, with the one end of the spring 84 adjoining the connecting conduit 44 while its other end rests upon the spherical body 86. The spring 84 urges the spherical body 86 against a piston end section orifice 76, such that the piston end section orifice 76 is closed by the spherical body 86 in the inactivated state of the piston pump. The piston end section orifice 76 is provided in the valve insert body 82 which has a seating surface for the spherical body 86. The valve insert body 82 and the piston end section 72 form an annular groove 88 on the side close to the inlet 20, in which groove an end of a piston spring 70 is received.

The piston spring 70 is disposed in the interior of a pressure generating chamber 13 between the piston 14 and the inlet 20. The piston spring 70 operates to return the piston 14 after it is moved towards the inlet 20 to compress the pressure generating chamber 13. The end of the piston spring 70 opposite the piston bears against a shoulder 90 of an essentially hollow cylindrical inlet insert body 92. The inlet insert body 92 is inserted into the housing bore 12 of the pump housing in the vicinity of the inlet 20. At an end close to the inlet 20, the inlet insert body 92 has an annular step flange 94 which surrounds by positive engagement an annular step flange of an inlet valve 74 in sealing manner with the pump housing 10, thus maintaining it in position.

The inlet valve 74 is equally arranged in close proximity to the inlet 20 and is surrounded by the inlet insert body 92. The inlet valve 74 is configured as a flap valve made of a flexible elastomeric material. It has a central inlet bore 75 with a continuous taper towards the end close to the piston 14, eventually terminating in two thin lips 77 urging against each other in sealing fashion. The space bounded by the inlet valve 74, the piston end sections 72 and the pump housing 10 forms the pressure generating chamber 13 whose volume can be reduced by axial displacement of the piston 14 in opposition to the piston spring 70.

Figure 3:
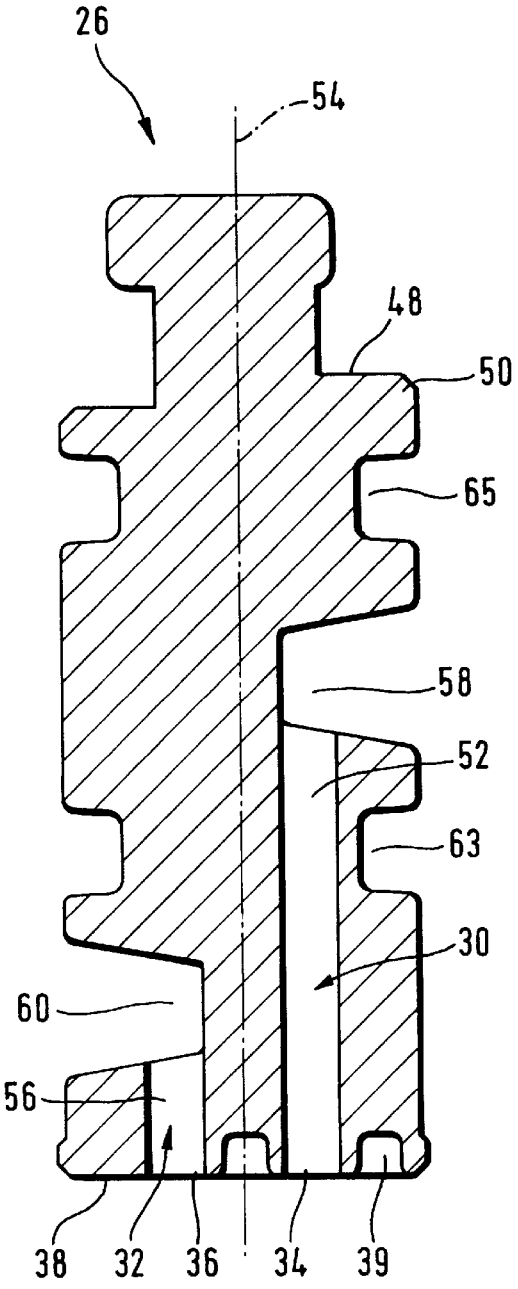
FIG. 3 is a longitudinal sectional view of a distributor element for the pump mechanism of FIG. 1.
Figure 4:
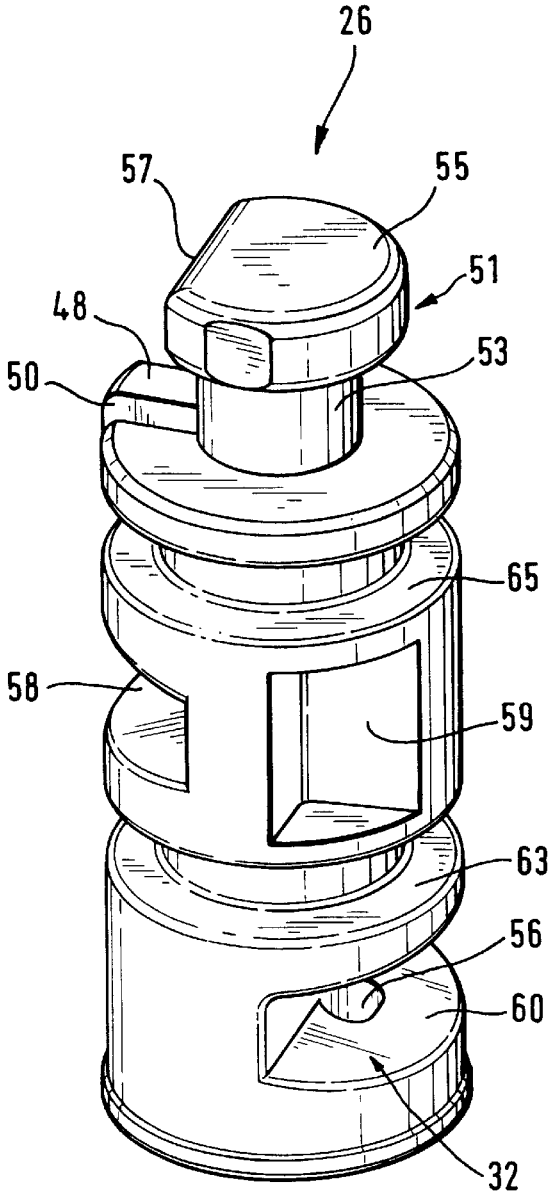
FIG. 4 is a perspective view of the distributor element for the pump mechanism of FIG. 1.

Completely received within the distributor bore 28 of the piston 14 is the distributor element 26. FIG. 3 shows the distributor element 26 in longitudinal section, while FIG. 4 shows the distributor element 26 in perspective. The distributor element 26 is substantially cylindrical in shape. On a side of the distributor element 26 remote from the activating element 24 and close to the bearing surface 42 of the distributor bore 28, an end surface 38 is provided where two bore sections 52, 56 terminate. The bore sections 52, 56 extend parallel to the axis of rotation 54 of the distributor element 26 and are arranged eccentrically and in mirror symmetry to each other.

In cross-section, the bore sections are configured as elongated holes, so that for the rotary position in which one of the two inlet ports 34, 36 is opposite the connecting conduit 44, there exists a larger overlap area for several angles of rotation of the distributor element 26. The two bore sections 56, 52 extend up to different levels in the distributor element 26. On the side remote from the end surface 38, the bore sections 52, 54 open into trapezoidal transverse grooves 58, 60 having their respective levels adapted to the levels of the associated outlets 16, 18.

The bore section 52 combines with the transverse groove 58 to form a conduit 30 extending up to about the middle of the distributor element in the longitudinal direction, and the bore section 56 combines with the transverse groove 60 to form a further conduit 32 opening into the outlet 18 for the extra shot of steam. The outlets 16, 18 forming circular orifices on the distributor bore 28, the transverse grooves 58, 60 produce an overlapping connecting area, so that minor deviations in the angle of rotation or height of the distributor element 26 within the distributor bore 28 nevertheless ensure full communication between the transverse grooves 58, 60 and the associated outlets 16, 18. The two transverse grooves 58, 60 are arranged laterally on opposite sides of the distributor element 26, so that the distributor element has to be rotated through an angle of 180° to connect the respective conduit 30, 32 with the connecting conduit 44 and one of the outlets 16, 18.

The transverse grooves 58, 60 are sealed relative to each other by a second seal. This second seal 62 is configured as an O-ring received in a circumferential annular groove 63 arranged between the first and the second transverse groove 58, 60. A further annular groove 65 for receiving a third seal 64 is disposed between the upper transverse groove 58 and the end of the distributor element 26 associated with the activating element 24. This annular groove 65 receives likewise therein an O-ring. The O-rings of the second and third seal 62, 64 protrude beyond the outside of the distributor element 26 a small amount, so that the O-rings are compressed in sealing fashion by the wall of the distributor bore 28. The inlet ports 34, 36 of the conduits 30, 32 are sealed relative to each other by a first seal 40. The first seal 40 is equally an O-ring, preferably made of rubber, which is received in an annular groove 39 provided around the inlet port 34. The inlet port 34 is associated with the conduit 30 which is connectible with the upper outlet 16 for the water spray 66. Thus, the first, second and third seal 40, 62 and 64, respectively, are arranged around the fluid path of the conduit 30 to effect a seal. This produces a particularly tight seal around the fluid path in which the higher fluid pressure is built up during actuation of the piston pump. The first seal 40 is urged into sealed engagement with the bearing surface 42 during an axial displacement of the piston, in particular when the piston 14 compresses the pressure generating chamber 13. The compressive force exerted in the axial direction for actuating the piston 14 corresponds substantially to the compressive force acting upon the first seal 40. The compressive force exerted on the activating element 24 for axial displacement of the piston 14 is transmitted by the activating element 24 to the distributor element 26 and thereby to the piston 14. To ensure optimum transmission of the direction of force lines of the compressive force to the first seal 40, the distributor element 26 includes a contact surface 48 arranged directly above the first seal 40 and in an area connecting with the activating element 24. As becomes apparent particularly from FIG. 4, the contact surface 48 is provided on a radial projection 50. The contact surface 48 forms essentially the sole axial connection between the activating element 24 and the distributor element 26.

The distributor element 26 has an upper head 51 which, as illustrated in FIG. 1, is in positive engagement within a recess of the activating element 24 in a radial direction, yet is spaced from the activating element in an axial direction. The head section 51 is composed of a slim, essentially cylindrical neck section 53 and an upwardly radially enlarged disk segment 55. The head section 51 has a flatted portion 57 along the side on which the projection 50 is formed, so that the contact surface 48 contacts the activating element 24 directly without any undercut on the head 51. For one purpose, the flatted portion 57 thus releases the contact surface 48 for the activating element 24, and for another purpose provides a safeguard against relative rotation of the distributor element 26 and the activating element 24, so that these two elements are rotationally fixed relative to each other.

As becomes further apparent from FIG. 4, two notches 59 are provided on the circumference of the distributor element 26 on the side opposite the upper transverse groove 58—one of the two notches 59 being shown in FIG. 4—which enables a more accurate shape of the plastic part to be obtained. Material shrinkage in the area of the notch 59 is thus avoided.

The activating element 24 is placed over the head section 51 of the distributor element 26. The activating element 24 is a control button of an essentially hollow cylindrical configuration and has a pressure surface 46 at the upper end section of the activating element 24 (in the position of the piston pump as installed, as illustrated in FIG. 1).

Figure 2:
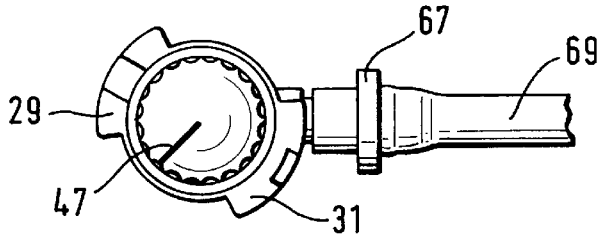
FIG. 2 is a top plan view of the pump mechanism of FIG. 1.

FIG. 2 shows the activating element in a top plan view. As becomes apparent from this Figure, the pressure surface 46 has a marking 47 printed on it indicating to the operator the rotary position to which the distributor element 26 is set or the liquid consuming device selected. The pressure surface 46 extends nearly parallel to the contact surface 48 and to the end surface 38 of the distributor element. This ensures likewise an optimum transmission of the applied compressive force to the first seal 40. Provided at a lower section of the activating element 24 are radially widening sectors 29, 31 engaging within corresponding recesses in the pump housing when the piston 14 is pushed in.

Connecting hoses 68, 69 are push-fitted in sealing fashion onto the pin-shaped outlets 16 and 18. The hose 69 which is connected with the upper outlet 16 communicates with the water spray 66 intended to spray-dampen the articles being ironed. By reason of the high fluid pressure that may be developed in the fluid path to the water spray 66, a retaining ring 67 is provided to affix the hose 69 for the water spray to the upper outlet 16, the ring being fitted between two projecting ramps on the outlet 16, thus preventing the hose 69 from slipping off.

The hose 68 connected with the lower outlet 18 leads to a steam generating chamber, not shown, of the iron, so that the quantity of water supplied to the steam generating chamber evaporates, issuing as an extra shot of steam through vent holes in the soleplate of the iron.

The pump housing 10, the piston 14, the inlet insert body 92, the valve insert body 82, the distributor element 26 and the activating element 24 are fabricated from POM plastics. Particularly by reason of the fact that each liquid consuming device has a conduit 30, 32 of its own in the distributor element 26, fluid pressure is not built up in that particular conduit 30, 32 that is not in communication with the connecting conduit 44 and one of the outlets 16, 18 during execution of a piston stroke, so that any residual liquid in the non-selected conduit cannot be expelled.

The mode of operation of the piston pump will be described in the following.

The operator rotates the activating element into one of the two desired positions in order to activate the water spray 66 or to produce an extra shot of steam. Rotation of the activating element 24 also involves rotation of the distributor element 26, so that only one of the two conduits 30, 32 communicates with an outlet 16, 18 and the connecting conduit 42. During rotation, the first seal 40 is not acted upon by a compressive force, thus preventing it from wear during rotation.

Then the operator presses the pressure surface 46 to urge the activating element 24 down, so that the distributor element 26 and the O-ring of the first seal 40 are urged axially into engagement with the bearing surface 42 of the piston 14, causing the first seal 40 to be compressed to effect a seal. The piston 14 moves axially towards the inlet 20, compressing the chamber or pressure generating chamber 13. As this occurs, the inlet valve 74 closes and the outlet valve 78 opens, so that the air contained in the pressure generating chamber 13 during the first stroke escapes through the outlet valve 78.

Subsequently, the piston moves upwards as a result of the expanding piston spring 70, whereby a pressure below atmospheric is produced in the pressure generating chamber 13, the outlet valve 78 closes, the inlet valve 74 opens, and water from the water reservoir is aspirated into the pressure generating chamber 13.

During the next piston downward stroke, the pressure generating chamber 13 is compressed again, causing the water contained therein to escape through the opening outlet valve and to be directed through the connecting conduit 44, one of the two conduits 30, 32, and one of the two outlets 16, 18 to the liquid consuming device. During the upward stroke of the piston 14, the outlet valve 78 closes, and more water is supplied to the pressure generating chamber 13 through the open inlet valve 74.

Figure 5:
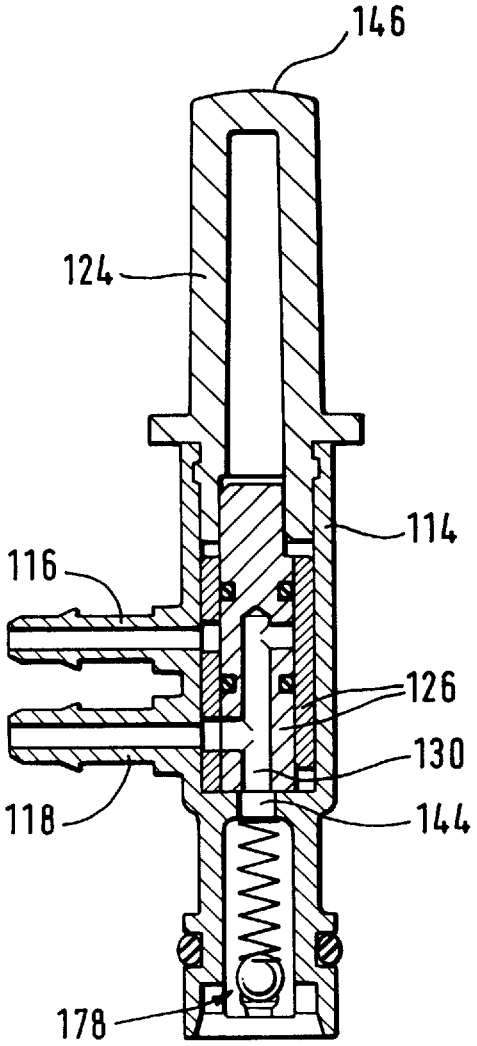
FIG. 5 is a longitudinal sectional view of a piston of a prior art piston pump.

FIG. 5 shows a longitudinal section through a piston 114 of a known piston pump. Parts corresponding to those in FIG. 1 are designated by reference numerals incremented by 100 so that for simplicity's sake this state of the art need not be explained in greater detail when the terms already used in the introductory part of the description are assigned to those of the description of FIG. 1.

We claim:

1. A steam iron with a pump mechanism adapted to supply liquid selectively to several liquid consuming devices of the steam iron, in which the pump mechanism includes:

a pump housing having a longitudinal bore;

a piston having in its interior a distributor bore, said piston fitting into the longitudinal bore in said pump housing, wherein the longitudinal bore combines with said piston to form a chamber having an inlet and two outlets for the liquid;

a distributor element rotatably mounted in said distributor bore, said distributor element having at least one conduit for each of the liquid consuming devices through which one of the liquid consuming devices can be supplied with liquid in dependence upon the rotary position of said distributor element, and said distributor having an inlet port for each conduit; and a seal, which seals the inlet ports relative to each other, wherein said seal effects a seal when acted upon by a compressive force.

2. The steam iron as claimed in claim 1, wherein said seal is adapted to be acted upon by a compressive force created by an actuation of said piston.

3. The steam iron as claimed in claim 1, wherein:

the distributor bore has a bearing surface;

said distributor element terminates in an end surface, arranged parallel to the bearing surface of the distributor bore;

at least one of the conduits terminates in the end surface of said distributor element;

said piston has a connecting conduit, that extends between the chamber and one of the conduits in said distributor elements, the connecting conduit terminating in the bearing surface;

said seal is arranged between the bearing surface and the end surface and around one of said inlet ports;

said seal is configured as an O-ring;

one of the inlet ports is opposite the connecting conduit in dependence upon the rotary position of said distributor element relative to the connecting conduit while the further inlet port is disconnected in sealed fashion from the connecting conduit; and the end surface of said distributor element extends in a plane normal to a direction of axial displacement of said piston.

4. The steam iron as claimed in claim 1, further comprising:

an activating element engageable with said distributor element for actuation of said piston and said distributor element; and a contact surface between said distributor element and said activating element wherein an actuating force exerted on said activating element acts essentially vertically on said seal, with the actuating force corresponding in amount and direction to a compressive force for sealing said seal.

5. The steam iron as claimed in claim 1, wherein each of the conduits has a bore section extending parallel to an axis of rotation of said distributor element, and a transverse groove adjoining the bore section, the transverse groove communicating with one of the outlets depending on the rotary position of said distributor element.

6. The steam iron as claimed in claim 5, wherein the bore section is configured as an elongated hole in cross-section.

7. The steam iron as claimed in claim 5, wherein the bore sections of the conduits are arranged eccentrically to the axis of rotation of said distributor element, and the transverse grooves are disposed in a 180° offset relation to each other.

8. The steam iron as claimed in claim 7, wherein said outlets are arranged in superposed fashion laterally on said piston.

9. The steam iron as claimed in claim 5, further comprising:

an activating element engageable with said distributor element for actuation of said piston and said distributor element; and at least two peripheral seals disposed on the circumference of said distributor element;

wherein the transverse grooves of the conduits are arranged on said distributor element at different levels and each at the height of its associated outlet; and the transverse groove lying closer to said actuating element is sealed relative to the transverse groove situated therebelow and relative to the environment thereabove by one of two said peripheral seals disposed on the circumference of said distributor element.

10. The steam iron as claimed in claim 4, wherein said iron has a soleplate and the liquid consuming devices provided include:

a water spray; and a water supply to produce an extra shot of steam issuing from the iron's soleplate, with said seal being provided around the inlet opening for the water spray, and said peripheral seals being arranged in sealing fashion around the transverse groove for the water spray.

11. The steam iron as claimed in claim 4, wherein said piston has an end section and said pump housing has an inlet on an end distal from said activating element, said pump mechanism further comprising:

a piston spring arranged between the piston end section on the side remote from said activating element and the inlet.

12. The steam iron as claimed in claim 1, wherein said piston has an orifice in an end section and said pump housing has an inlet at an end distal from said activating element, said pump mechanism further comprising an inlet valve on the inlet at said pump housing; and an outlet valve between the piston end section orifice and a connecting conduit in said piston, wherein the connecting conduit extends between the chamber and one of the conduits in said distributor element, the connecting conduit terminating in a bearing surface of the distributor bore.

13. The steam iron of claim 12, wherein said inlet valve is a flap valve.

14. The steam iron of claim 12, wherein said outlet valve is a spring-loaded ball valve.

* * * * *